US007413297B1

(12) United States Patent
Jones

(10) Patent No.: US 7,413,297 B1
(45) Date of Patent: Aug. 19, 2008

(54) FULL LIQUID VERSION OF INK JET CASSETTE FOR USE WITH INK JET PRINTER

(75) Inventor: Bruce S. Jones, Franklin, TN (US)

(73) Assignee: NuKote International, Inc., Rochester, NY (US)

( * ) Notice: Subject to any disclaimer, the term of this patent is extended or adjusted under 35 U.S.C. 154(b) by 0 days.

(21) Appl. No.: 10/758,306

(22) Filed: Jan. 16, 2004

Related U.S. Application Data

(63) Continuation of application No. 10/170,763, filed on Jun. 13, 2002, now Pat. No. 6,749,293.

(60) Provisional application No. 60/298,037, filed on Jun. 13, 2001.

(51) Int. Cl.
*B41J 2/175* (2006.01)

(52) U.S. Cl. ..... 347/86; 347/85

(58) Field of Classification Search ..... 347/29, 347/84–87, 93
See application file for complete search history.

(56) References Cited

U.S. PATENT DOCUMENTS 3,953,862 A * 4/1976 Amberntsson et al. ..... 347/87
4,463,362 A * 7/1984 Thomas ..... 347/86
5,085,355 A * 2/1992 Yoshimura et al. ..... 222/564
5,700,315 A * 12/1997 Wenzel ..... 106/31.58
5,801,737 A 9/1998 Sato et al.
5,949,461 A 9/1999 Jones et al.
6,536,861 B1 * 3/2003 Usui et al. ..... 347/7
6,830,321 B2 * 12/2004 Okamoto et al. ..... 347/86
2002/0097283 A1 * 7/2002 Askern et al. ..... 347/7
2004/0022559 A1 * 2/2004 Kusano et al. ..... 399/262

FOREIGN PATENT DOCUMENTS

EP 1 270 235 A1 1/2003

* cited by examiner

*Primary Examiner*—Julian D. Huffman
*Assistant Examiner*—Jason S Uhlenhake
(74) *Attorney, Agent, or Firm*—Fay Sharpe LLP

(57) ABSTRACT

An ink cartridge having a one-piece housing including a plurality of walls to form a chamber for receiving ink. The housing is formed of a blow-molded plastic material. An outlet passage extends from a bottom wall communicating with the chamber. A seal and cap assembly are secured to the outlet passage. A vent opening is provided in a top wall. The vent includes a porous member and a cap to secure the porous member within the vent. The housing is fully filled with ink. The housing allows for the use of pigmented ink since no foam reservoir is provided.

3 Claims, 4 Drawing Sheets

FIG. 4
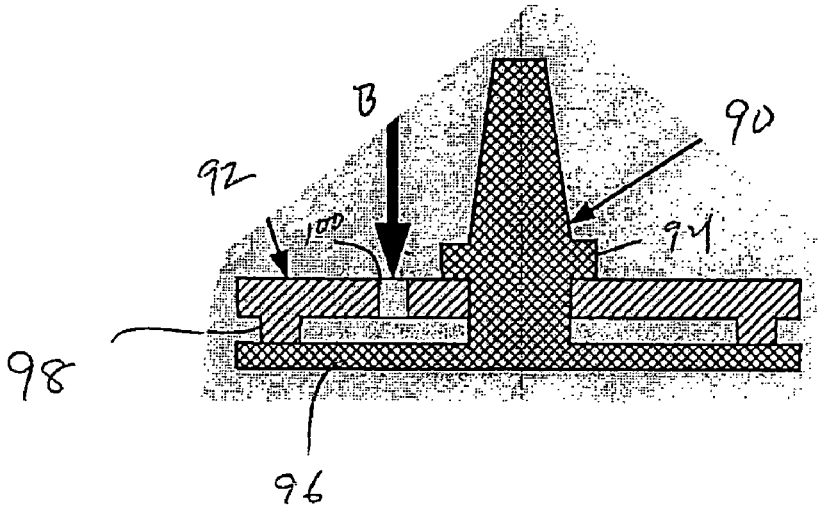
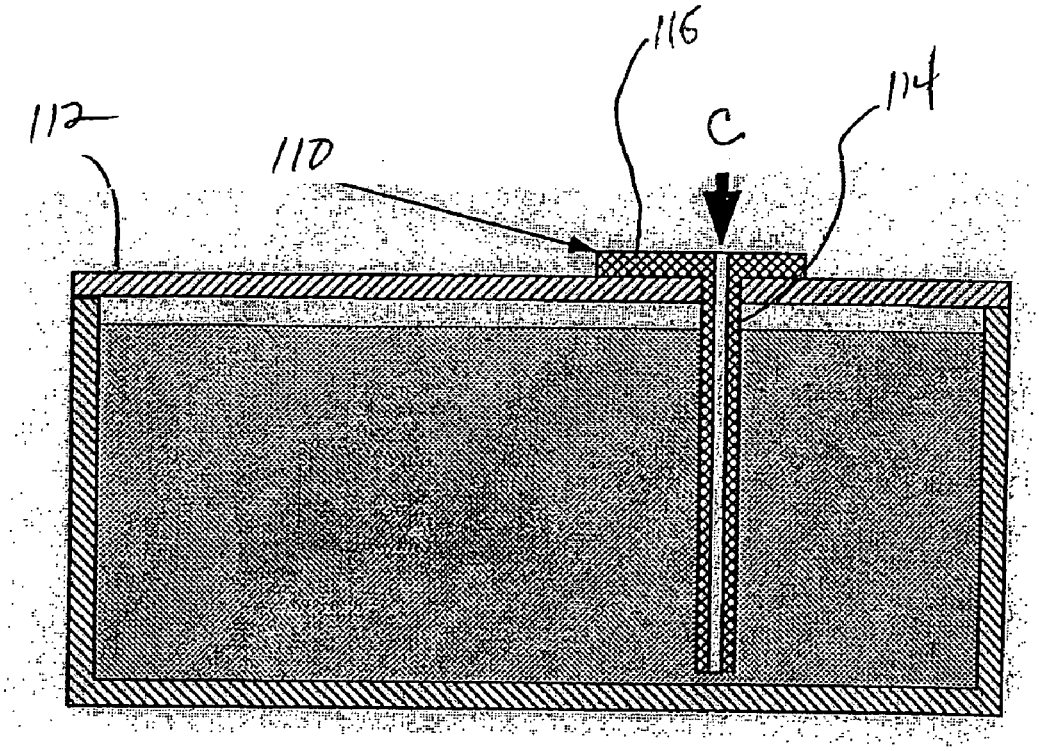
FIG. 5

FULL LIQUID VERSION OF INK JET CASSETTE FOR USE WITH INK JET PRINTER

CROSS-REFERENCE TO RELATED APPLICATIONS

This patent application is a continuation, of application Ser. No. 10/170,763 filed on Jun. 13, 2002 now U.S. Pat. No. 6,749,293, which claims priority of Ser. No. 60/298,037 filed on Jun. 13, 2001, and incorporated herein by reference.

BACKGROUND OF THE INVENTION

This invention relates to an ink jet cartridge or cassette as used in an ink jet printer, more particularly to an ink jet cartridge which has a one-piece housing filled with ink and does not have a foam member. It will be appreciated, however, that the invention may find application in other applications and environments that encounter the same issues.

It is generally known in the art to form a cartridge housing or body having one or more cavities or chambers to hold a predetermined supply of ink. For example, a single color of ink may be provided into a chamber cartridge or multiple chambers may be provided, for example, each holding a different color ink stored therein for selective use in a printer.

It is also generally known to provide an ink absorbing member such as reticulated polyurethane or melamine foam that fits within one or more of the chambers. In some arrangements, the ink absorbing member fills the substantial entirety of the chamber, where in other instances a portion of the ink supply is free ink and the remainder of the ink is stored in the ink absorbing member. One or more outlet ports communicate with the respective one or more chambers through outlet passages. The outlet passage proceeds to a first or bottom wall of the housing. A supply needle from an associated printer extends through the outlet port and thus conveys ink from the housing to a recording head or a print head.

Typical ink jet cartridges are formed of a welded construction. The cartridge includes a housing and a lid or cover member welded onto the housing. The welding process adds time and expense to the manufacturing process of the cartridge. There is a need for a one-piece, homogeneous, integrally formed housing for an ink jet cartridge.

An ink absorbing member or foam is typically used as a resistive force to meter ink flow. There is, however, a need for an ink jet cartridge which does not use the foam reservoir. This allows use of pigmented ink in the cartridge which has an archival print. Foam reservoirs prevent the use of pigmented ink since the foam acts as a filter thus trapping pigment solid particles within the foam. A blow-molded single casing ink jet cartridge with a diaphragm-type venting mechanism would permit the use of pigmented ink. Thus, there is a need for a full liquid ink jet cartridge which does not have a foam reservoir to allow the use of pigmented ink in an ink jet printer.

SUMMARY OF THE INVENTION

The present invention provides an ink jet cartridge fabricated from a one-piece construction and fully filled with ink. More specifically, the ink cartridge includes a housing having a plurality of walls forming a top surface, a bottom surface, and side walls connecting the top and bottom surfaces. The walls form a chamber for receiving ink.

The housing is a one-piece, integral construction and is formed from a blow-molded plastic material. The housing is adapted to be fully filled with ink. In the preferred embodiment, the housing receives a pigmented ink. However, other inks may also be received by the housing.

An outlet passage extends from the bottom surface and communicates with the chamber and through which ink is selectively dispensed. A flexible seal is selectively attached to the outlet passage. A cap secures the seal to the passage.

A vent is formed on the top surface. The vent can include a porous member which is secured in the vent via a cap member. The porous member can have cell sizes which are adapted to allow air inflow to substantially equal ink outflow. The cap is a screw cap which is threadedly secured to the vent.

The vent can comprise a spring-loaded ball and cap assembly which secures the ball to the vent. Alternatively, the vent can comprise a diaphragm valve within the vent. The vent can also comprise a suction tube which extends from the vent opening to the bottom surface of the cartridge. A cap secures the tube to the vent opening.

A primary advantage of the invention resides in the housing being formed of a one-piece construction.

Another advantage of the invention relates to the ease of manufacture of the cartridge.

Still another advantage of the invention is found in the elimination of the foam member which reduces costs.

Yet another advantage is found in the ink cartridge which allows the use of pigmented ink.

Still yet further advantage resides in the ease and expense at which such improvements are achieved.

Still other aspects of the invention will become apparent to those skilled in the art upon reading and understanding the following detailed description.

BRIEF DESCRIPTION OF THE DRAWINGS

The invention may take form in certain components, structures, and steps, preferred embodiments of which will be illustrated in the accompanying drawings wherein:

FIG. 4 is an enlarged cross-sectional view of a diaphragm valve vent assembly for use with the full liquid ink cartridge of FIG. 2; and, FIG. 5 is a cross-sectional view of a full liquid ink cartridge having a vent tube metering device.

DETAILED DESCRIPTION OF THE INVENTION

Figure 1:
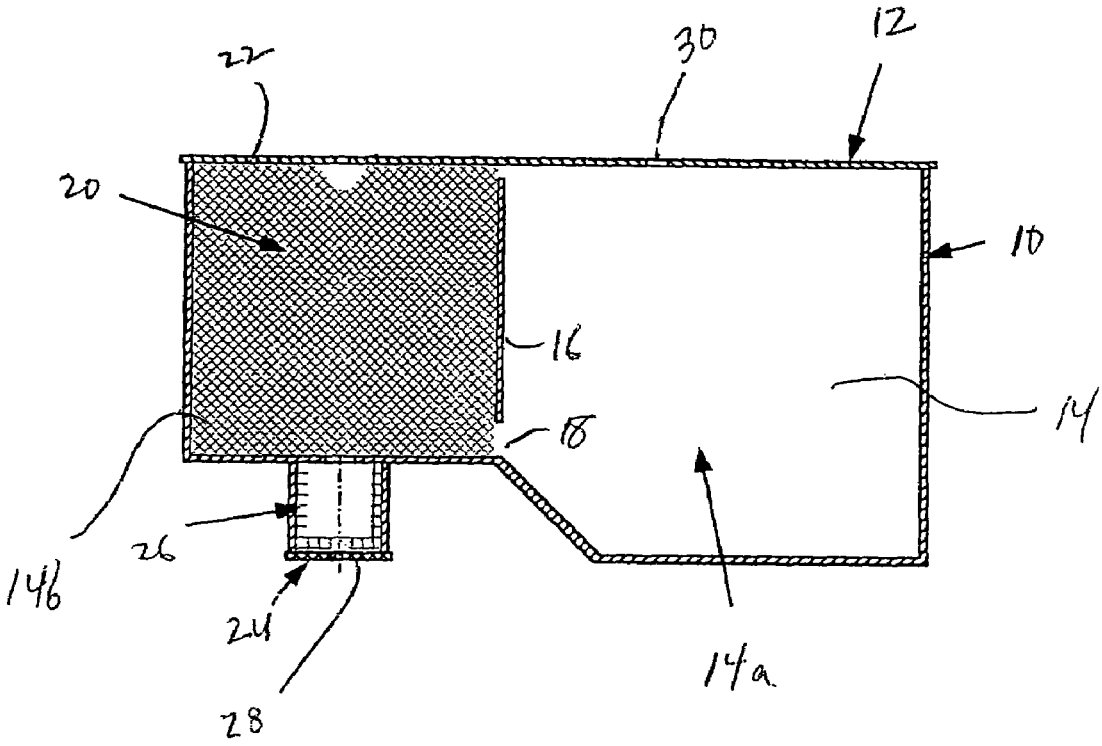
FIG. 1 is a cross-sectional view of an ink jet cartridge with a partial free ink/partial foam design.

FIG. 1 illustrates an ink jet cassette which has a free ink chamber and a foam chamber. The ink jet cassette or cartridge 10 includes a housing 12 having an internal chamber or cavity 14. The housing interior is divided into two chambers 14*a*, 14*b* by a dividing wall 16. In this partial free ink/partial foam design, a passageway 18 is provided in a base portion of the dividing wall to allow ink to migrate from the free ink side 14*a* to an ink absorbing member 20 provided in the chamber 14*b*. The ink absorbing member is typically a block of porous material or foam such as a reticulated polyurethane foam or melamine foam, or other conventional ink absorbing member used to store ink within the pores thereof. As seen in FIG. 1, with the partial free ink/partial foam design, the ink absorbing member 20 substantially fills the entire chamber 14*b* on the foam side of the cartridge.

A lid or cover 22 is received over a first or upper end of the housing and is typically sealingly secured into place. For example, the cover may be ultrasonically welded along a peripheral portion to the cartridge housing to seal the components together. An ink outlet port 24 located at the bottom of foam chamber 14*b* communicates via an outlet passage 26 with the chamber of the cartridge. In this manner, ink flows from the ink chamber through the outlet passage and ultimately reaches the outlet port 24. The outlet port receives an elastomeric grommet member 28 that is selectively pierced by a needle from the associated printer (not shown) to establish communication through the outlet port of the outlet passage 26 in a manner generally well known in the art. Venting is accomplished through a vent hole or opening 30 located in the cover.

Figure 2:
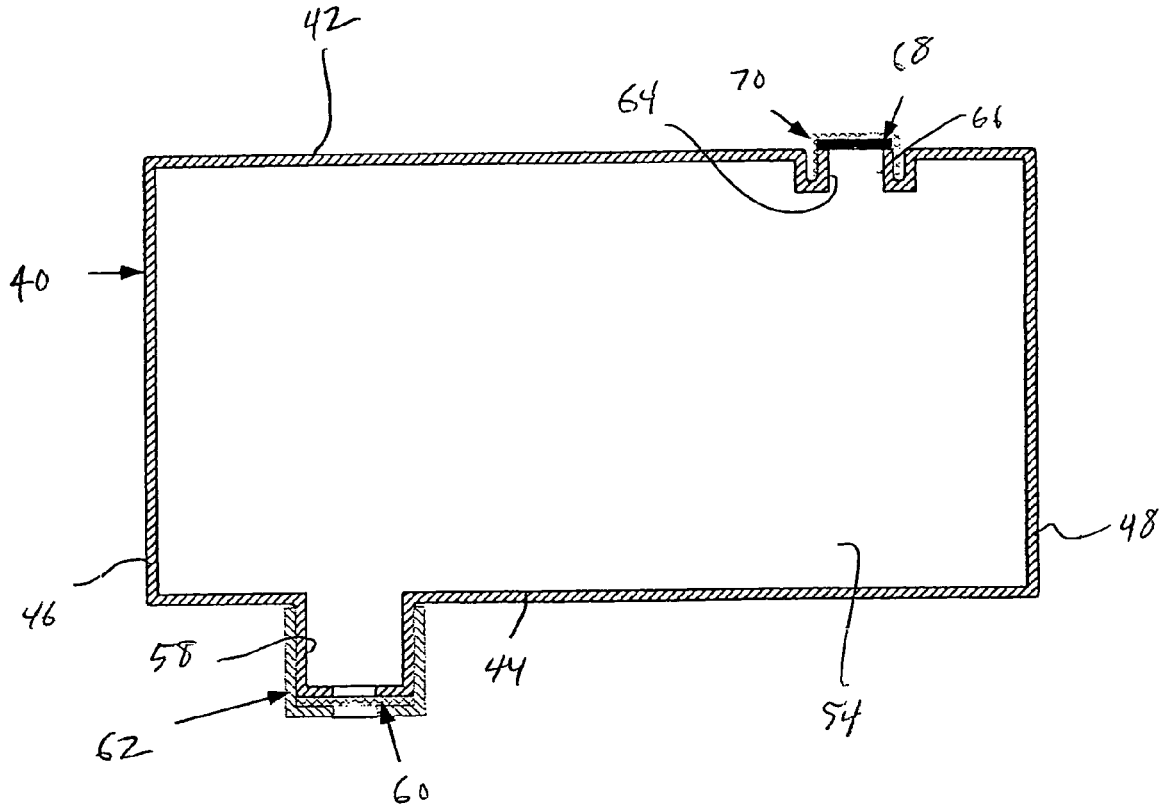
FIG. 2 is a cross-sectional view of a full liquid ink jet cartridge in accordance with the preferred embodiment of the present invention.

FIG. 2 shows a full liquid ink jet cartridge in accordance with the preferred embodiment. The cartridge has a housing or casing 40 which has a plurality of walls which form a top surface 42, bottom surface 44, and a plurality of side walls 46, 48 which connect the top and bottom surfaces together to form a chamber 54 for receiving ink. The cartridge is shown to have one chamber. However, additional chambers filled with different colored inks could also be provided without departing from the scope of the invention.

The housing is formed of a one-piece, integral construction, e.g., a blow-molded plastic material. However, it should be recognized that other materials could be used to form the housing. Since the housing is of one-piece, welding a lid onto a housing is eliminated, thus saving time and expense in manufacturing the cartridge.

The housing is adapted to be fully filled with ink. The housing does not include or require a porous or ink absorbing member. Thus, the housing allows for the use of pigmented ink which has an archival print. Pigmented ink has solid particles which are suspended in a solution. The advantage of pigmented ink is that solid particles do not fade with exposure to light, unlike color dye molecules. This is known as archival print which tends to retain more solid particles on the paper or medium onto which printing is performed.

Foam members are intended to function as filters to filter particulates out of the ink. Thus, the solid particles in the pigmented ink could become trapped within the pores of the foam, thus filtering the ink.

Secondly, foam members have a chemical composition which could affect the chemical composition (such as pH) of the pigmented ink. Thus, pigmented ink cannot be used with a foam filled cartridge since the pigment may become trapped within the pores of the foam or may become affected by the chemical composition of the foam.

An outlet passage 58 extends from the bottom surface and communicates with the chamber and selectively dispenses ink out of the cartridge. A flexible seal 60 is selectively attached to the outlet passage. The seal performs essentially the same function as the grommet 28 in the ink cartridge of FIG. 1. A cap 62 secures the seal to the outlet passage. The cap is preferably a screw cap which is threadedly secured to the outlet passage.

A vent 64 is formed on the top surface 42 of the cartridge. The vent has an opening 66, a porous member 68, and a cap member 70 which secures the porous member within the opening of the vent. The cap 70 is also a screw cap which threadedly secures the porous member to the vent opening. The porous member 68 has cell sizes which are adapted to allow air in-flow to the chamber to be substantially equal to ink out-flow through the outlet passage.

Figure 3:
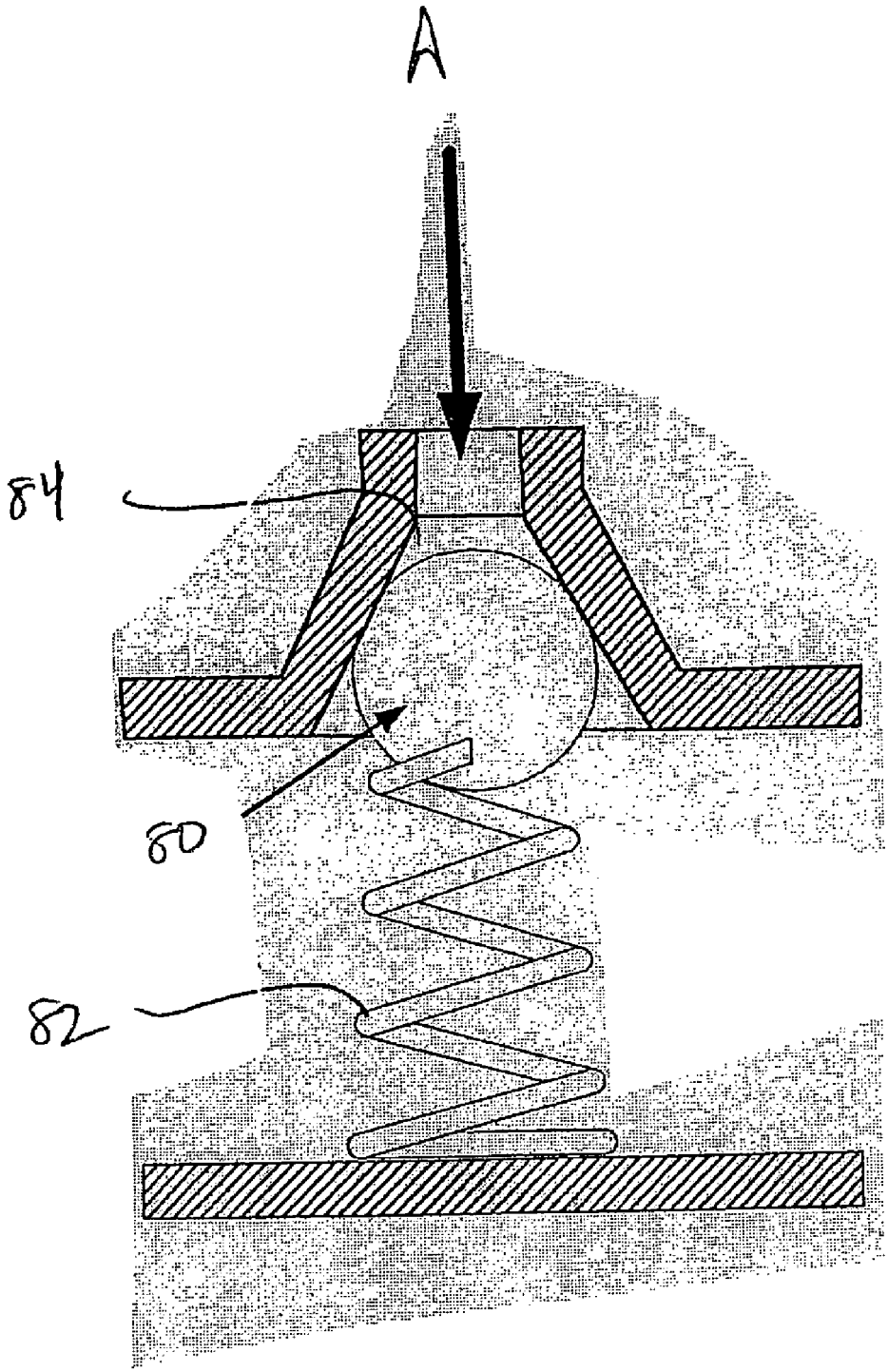
FIG. 3 is an enlarged cross-sectional view of a spring loaded ball vent assembly for use with the full liquid ink cartridge of FIG. 2.

Other alternative means of venting the casing may be used. For example, referring to FIG. 3, a spring loaded ball may be alternately used to provide venting to the casing and allow the ink to flow through the ink outlet port. The spring loaded ball assembly includes a ball 80 made of metal or plastic, and a helix spring 82 which biases the ball within vent hole or opening 84. Air flow A is metered into the cartridge chamber by the force load of the spring and the diameter of vent hole 84.

Another alternative vent assembly is shown in FIG. 4. A diaphragm valve 90 is inserted into an opening in housing top surface 92. The valve is fabricated from rubber or another elastic material. The valve is formed in a substantially T-shaped configuration. A portion of the valve is inserted into the opening where the barb or ledged area 94 locks it into position. Wing area 96 of the valve engages stub portions 98 of the cartridge housing. Air flow B occurs through opening 100 in the housing. The air flows only in one direction and the metering effect of the valve varies according to the material type, hole diameter and amount of flex available in the valve.

Yet another alternative valve assembly is shown in FIG. 5. A molded vent or suction tube 110 is inserted into an opening or hole in a top surface 112 of the ink cartridge. A long suction tube 114 is sealed in the hole. The tube 114 is secured within the opening by a cap 116. Air flow C displaces the ink loss during printing by air traveling through the suction or vent tube. The air flow is metered by the force required to overcome the head pressure of the ink and by the diameter of the tube. As the ink is depleted, the head pressure at the ink jet nozzles drops and the air flow drops at a proportionate rate.

The casing is fully filled with ink to a level where printing may be accomplished without flooding the outlet port. One advantage of this embodiment is elimination of the need of the foam reservoir in the casing. This, in turn, reduces the cost of fabricating the cartridge.

Another advantage of this embodiment is the ability to use pigmented ink in the cartridge which has an archival print. Pigmented ink cannot be used with a cartridge with a foam member since the foam acts as a filter.

The application has been described with reference to the preferred embodiment. Obviously, alterations and modifications will occur to others upon a reading and understanding of the specification. It is intended to include all such modifications and alterations insofar as they come within the scope of the appended claims or the equivalents thereof.

Having thus described the preferred embodiment, the invention is now claimed to be:

1. In an ink cartridge comprising a housing having a top wall including a cylindrical neck having an upper, outer end, a bottom wall and side walls forming a chamber for receiving ink, an outlet passage through said bottom wall for dispensing ink from said chamber, and a vent including an opening through said top wall for venting air into said chamber from atmosphere, the improvement comprising: said opening extending through said top wall cylindrical neck, said vent being a porous member resting on said upper, outer end of said cylindrical neck to cover said opening and having cells sized to allow air flow into said chamber substantially equal to ink flow through said outlet passage, and a cap securing said porous member on said neck.

2. In an ink cartridge comprising a housing having a top wall, a bottom wall and side walls forming a chamber for receiving ink, an outlet passage through said bottom wall for dispensing ink from said chamber, and a vent including an opening through said top wall for venting air into said chamber from atmosphere, the improvement comprising: said opening through said top wall including a cylindrical neck having an outer end, said vent being a porous member resting on said outer end to cover said opening and having cells sized to allow air flow into said chamber substantially equal to ink flow through said outlet passage, and a cap securing said porous member on said neck, wherein said cylindrical neck extends inwardly of said chamber from said top wall and is surrounded by a peripheral recess, whereby said outer end of said neck is adjacent the outer side of said top wall.

3. The ink cartridge according to claim 2, wherein said cap includes a skirt extending into said recess.

* * * * *